United States Patent [19]

Takagi et al.

[11] Patent Number: 4,497,293

[45] Date of Patent: Feb. 5, 1985

[54] INTERNAL COMBUSTION ENGINE OF MOTORCYCLE

[75] Inventors: Masatoshi Takagi, Tokyo; Wataru Annaka, Saitama, both of Japan

[73] Assignee: Honda Giken Kogyo Kabushiki Kaisha, Tokyo, Japan

[21] Appl. No.: 442,990

[22] Filed: Nov. 19, 1982

[30] Foreign Application Priority Data

Nov. 28, 1981 [JP] Japan ..... 56-189892

[51] Int. Cl.[3] ..... F02M 1/00

[52] U.S. Cl. ..... 123/196 A; 123/195 A; 123/198 C; 184/6.25; 180/219

[58] Field of Search ..... 123/196 A, 195 A, 196 R, 123/198 C; 184/6.24, 6.25; 180/219, 227; 210/168, 416.5

[56] References Cited

U.S. PATENT DOCUMENTS

| | | | |
|---|---|---|---|
| 3,707,202 | 12/1972 | Dixon | 123/196 A |
| 4,114,586 | 9/1978 | Fujikawa et al. | 123/198 C |
| 4,295,964 | 10/1981 | Preisler | 210/168 |
| 4,306,524 | 12/1981 | Spiess et al. | 123/196 R |
| 4,339,964 | 7/1982 | Isaka | 180/219 |

FOREIGN PATENT DOCUMENTS

| | | | |
|---|---|---|---|
| 2705090 | 8/1978 | Fed. Rep. of Germany | 123/195 A |

*Primary Examiner*—E. Rollins Cross

*Attorney, Agent, or Firm*—Sughrue, Mion, Zinn, Macpeak & Seas

[57] ABSTRACT

An internal combustion engine of a motorcycle includes an oil filter fixed to a rear portion of a crank case. The crank case accommodates therein an oil pump connected to the oil filter. The oil filter is detachably provided by means of threading engagement with the crank case.

13 Claims, 10 Drawing Figures

INTERNAL COMBUSTION ENGINE OF MOTORCYCLE

BACKGROUND OF THE INVENTION

The present invention relates to an internal combustion engine of a motorcycle, and more particularly, to the layout of an oil filter and its associated members.

According to a conventional motorcycle engine, the oil filter is provided at a position in front of the crank case. However, since the exhaust pipe is also disposed in front of the crank case, it is difficult to clean the casing of the oil filter to remove the mud splashed from the front wheel. Further, since the oil filter casing protrudes toward the front wheel, the outer appearance of the resultant motorcycle is degraded. Furthermore, the oil filter casing may be subjected to heat, since it is positioned adjacent to the cylinders of the engine and the exhaust pipe, so that it is necessary to often carry out maintenance work. Moreover, the oil pump is positioned at a position behind the center axis of the crankshaft. Therefore, the oil passage becomes long when the oil filter casing is disposed in front of the crank case.

SUMMARY OF THE INVENTION

It is, therefore, an object of the invention to overcome the above mentioned drawbacks and to provide an improved internal combustion engine for a motorcycle.

Another object of the invention is to provide such an internal combustion engine wherein the cleaning of the oil filter casing is easily carried out, and the outer appearance of the motorcycle is improved.

Still another object of the invention is to provide such an engine capable of preventing the oil filter casing from heating, and capable of minimizing the length of the oil passage.

Still another object of the invention is to provide such an engine, wherein a space defined by the crank case, a pivot shaft and the muffler and down tubes if any is effectively utilized.

These and other object of the present invention will be attained by providing the oil filter casing at a rear position of the crank case. The motorcycle provides a V-array of cylinders disposed above the crank case, and an oil pump and an oil strainer are provided within the crank cases. The oil pump has an inlet connected to a strainer submerged in the oil in the oil pan and has an outlet connected to the oil filter. At the outside of the crank case, a water pump is detachably provided whose rotary shaft is in alignment with a rotary shaft of the oil pump. The oil filter is detachably provided relative to the crank case by means of a thread. According to one embodiment of the invention, the oil filter is positioned substantially at the lateral center and between a pair of exhaust pipes. According to another embodiment of the invention, the oil filter is positioned offset from the lateral center and between a pair of down tubes. The crank case is subdivided into right and left cases, and the water pump is secured to the right case from outside, while the oil pump is secured to the right case from inside. The rotation shaft of the oil pump has one end integrally provided with a sprocket and the other end provided with a projection. The sprocket is connected to a sprocket of a main shaft of the transmission means by an endless chain. The shaft of the water pump has one end provided with a recess adapted to fit with the projection of the shaft of the oil pump upon attachment of the water pump to the right case, and has the other end provided with vanes. Lower portions of the right and left cases define the oil pan. The oil pump is disposed below the transmission means and is positioned at the rear side of the central axis of the crank shaft.

DETAILED DESCRIPTION OF THE PREFERRED EMBODIMENTS

Figure 1:
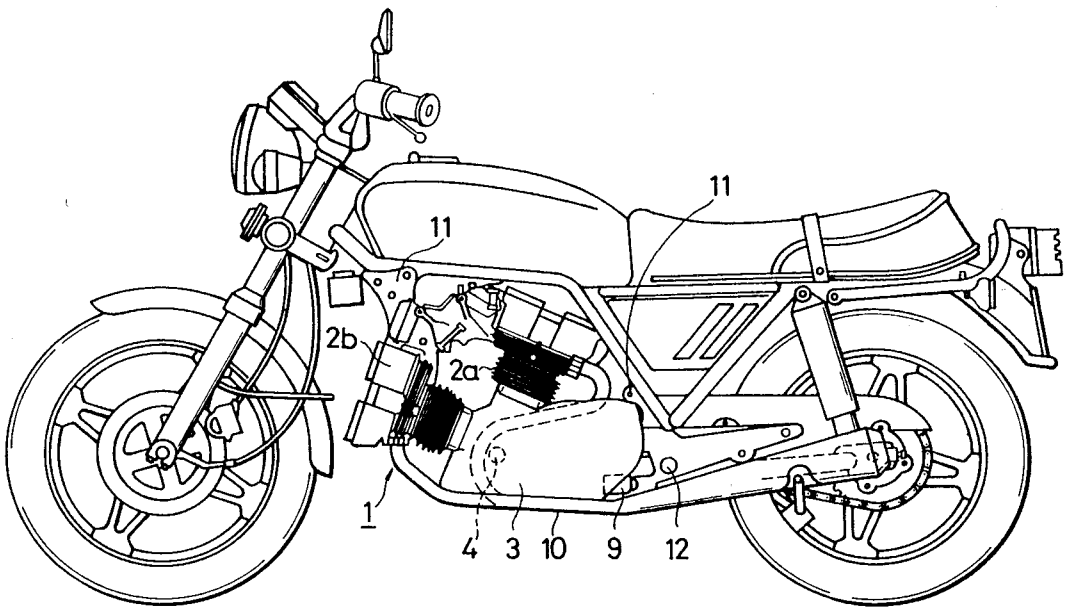
FIG. 1 is a side view showing a motorcycle provided with an internal combustion engine according to a first embodiment of the invention.
Figure 2:
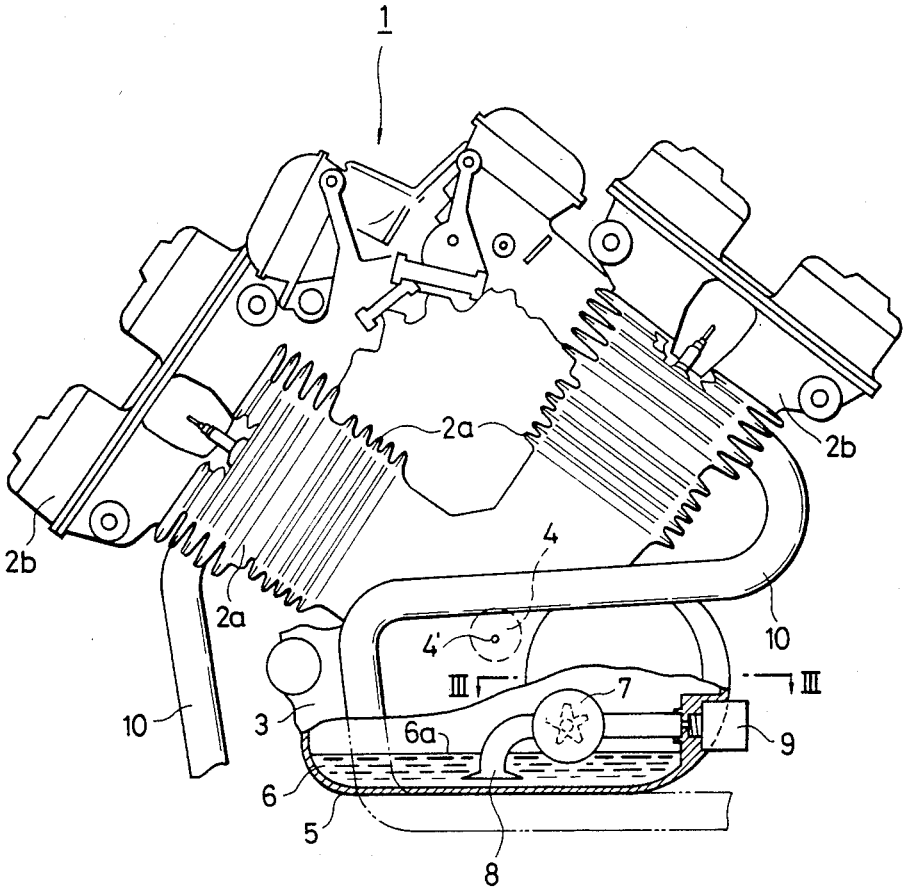
FIG. 2 is a partial cross-sectional view showing an oil filter and an oil pump according to the first embodiment.
Figure 3:
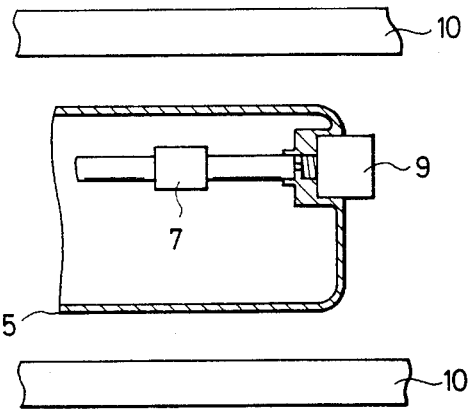
FIG. 3 is a plan view as viewed from arrow lines III—III of FIG. 2.

A first embodiment of the present invention is shown in FIGS. 1 to 3. In FIGS. 1 and 2, four cycle two cylinder V-type engine 1 for a motorcycle includes cylinders *2a*, cylinder head *2b*, a power transmission assembly provided in a crank case 3, and a crank shaft 4 extending in the transverse direction and positioned within the crank case 3. The engine is fixedly secured to a frame of the motorcycle by means of brackets 11. A pair of exhaust pipes 10 extend from the cylinders *2a* and are oriented substantially in the horizontal direction. Reference numeral 12 designates a pivot shaft. As best shown in FIG. 2, an oil pump 7 is disposed within the crank case 3, and is positioned at the rear with respect to the center 4' of the crank case 4. An oil strainer 8 is connected to the oil pump 7 and is submerged in the oil 6 accumulated in an oil pan 5. An outlet port of the oil pump 7 is connected to an oil filter 9. The oil filter is provided at the rear of the crank case 3. That is, the oil filter 9 is disposed at a location defined by the crank case 3, the pivot shaft 12 and the pair of exhaust pipes 10 or mufflers.

As shown in FIG. 3, the oil filter 9 is positioned substantially at the lateral center of the engine. The oil filter is removable from the crank case 3 by means of threading engagement. Further, as shown in FIG. 2, the oil filter 9 is positioned in the vertical direction so that part of the oil filter 9 is below the regular oil level *6a*. The oil filter 9 is connected to various lubricating portions of the engine 1 through oil passages (not shown). The oil circuit will be described in the second embodiment in detail.

With this structure, upon engine start, the oil pump 7 is operated to supply oil into the oil filter 9 through the oil strainer 8. The oil is filtered at the oil filter 9 and is supplied to the lubricating portions of the engine 1.

Figure 4:
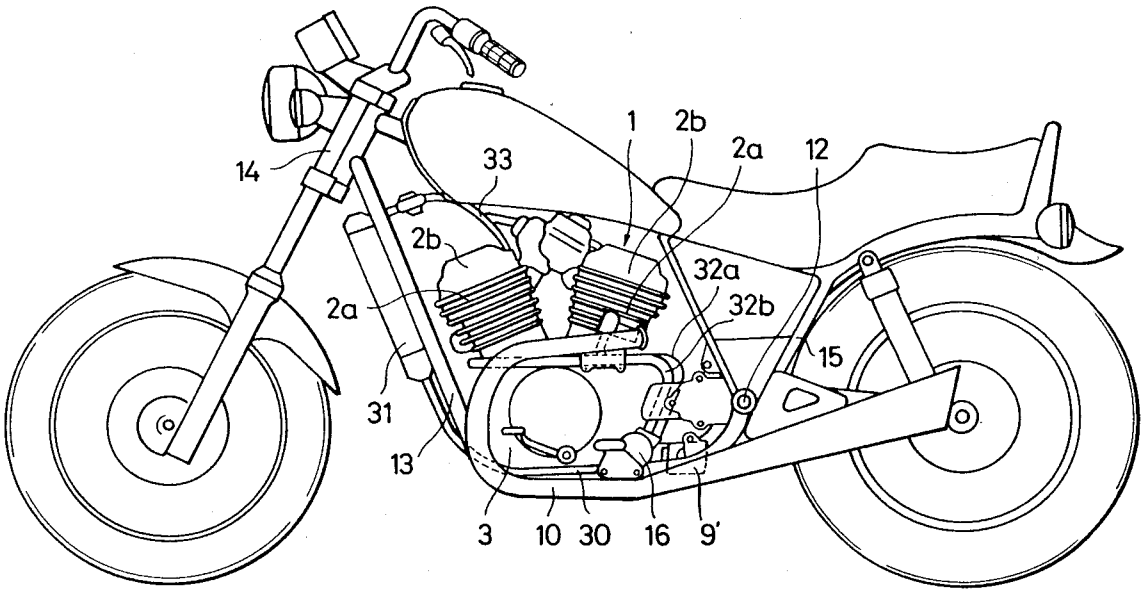
FIG. 4 is a side view showing a motorcycle of the double cradle frame type and provided with an internal combustion engine according to a second embodiment of the invention.
Figure 5:
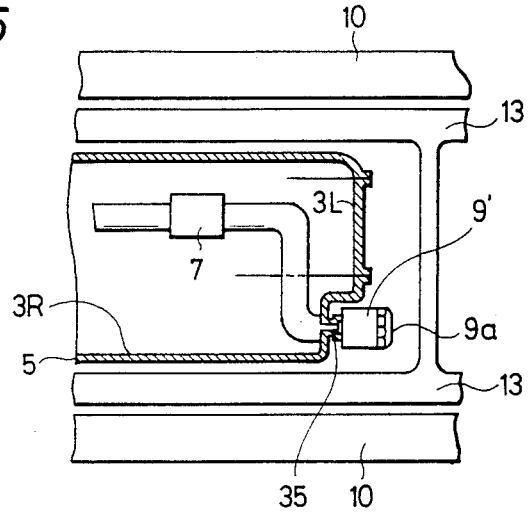
FIG. 5 is a plan view showing an oil filter and an oil pump according to the second embodiment.

A second embodiment of the invention is shown in FIGS. 4 to 10. As shown in FIG. 4, the motorcycle includes double cradle type down tubes extending between a head pipe 14 and a rear frame 15. An engine 1 is mounted on the down tubes 14. According to the second embodiment, an oil filter 9' is disposed at the rear side of the crank case 3, and at a location defined by the crank case 3, down tubes 13 and a pivot shaft 12. As shown in FIG. 5, the oil filter 9' is not positioned at the lateral center of the case 3, but is positioned offset from the center. With this structure, attachment or detachment of the oil filter 9 is easily carried out.

Figure 6:
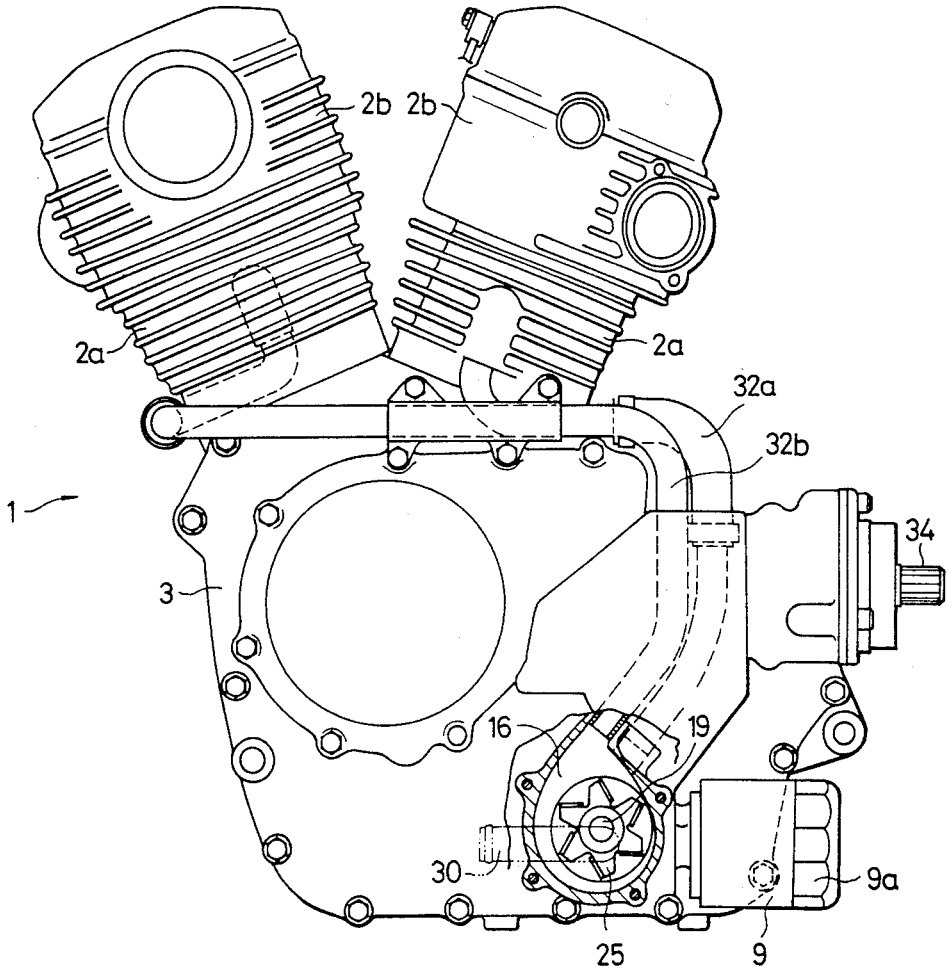
FIG. 6 is a side view showing an essential portion of the invention.
Figure 7:
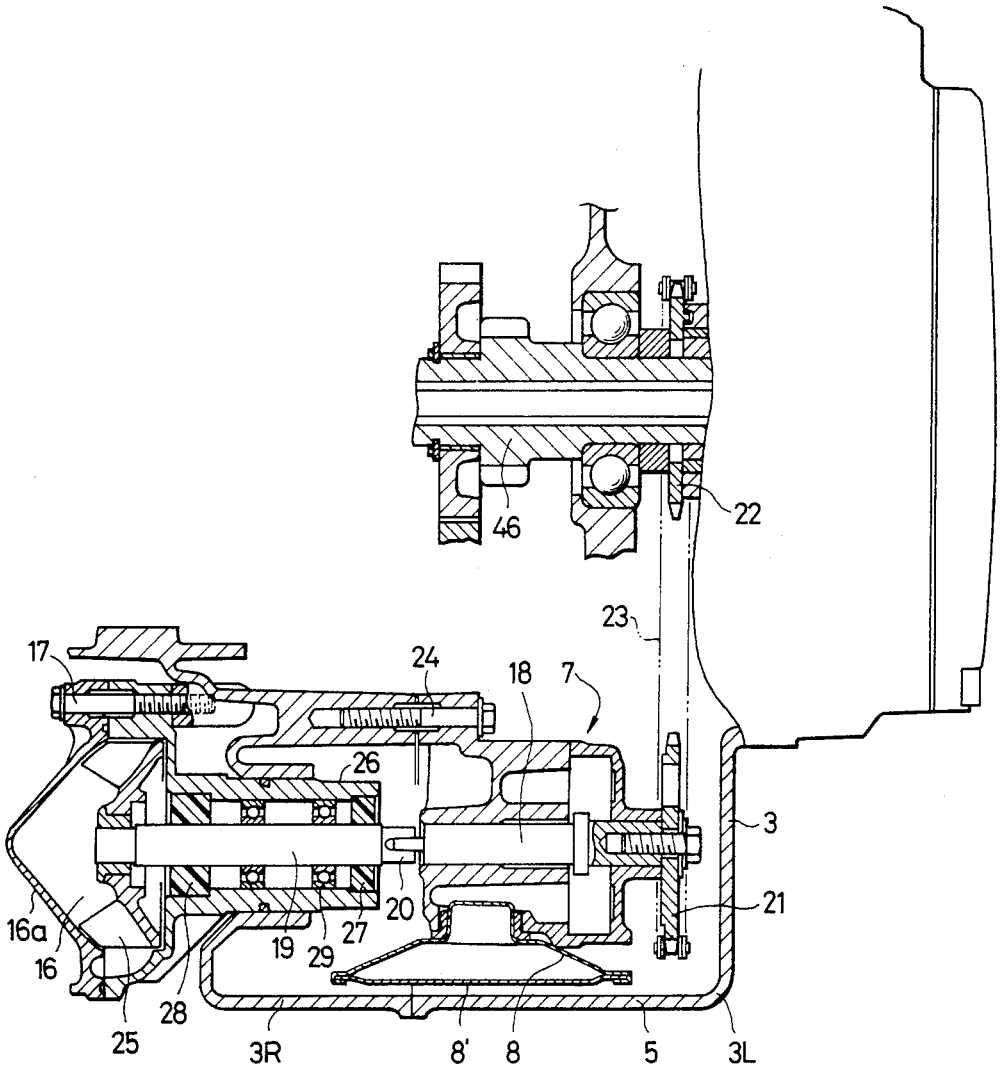
FIG. 7 is a cross-sectional view showing the positional relationship among the oil pump, water pump and the main shaft of a transmission means according to the invention.

FIGS. 6 through 9 show the positional relationship between the oil lubrication circuit and the water cooling circuit. As best shown in FIG. 7, the oil pump 7 and the oil strainer 8 are positioned within the crank case 3. However, the water pump 16 is exposed to the atmosphere. The water pump 16 is detachably provided from the outside by means of a bolt 17, and a cover **16*a* of the water pump 16 is removable by releasing the bolt 17. A rotary shaft 18 of the oil pump 7 is coaxial with a rotary shaft 19 of the water pump 16. These shafts 18 and 19 are separable because of the projection-recess engagement as at 20. The rotary shaft 18 of the oil pump 7 is rotated by the rotation of a main shaft 46 of the transmission system. The shafts 18 and 46 are provided with sprockets 21 and 22, and an endless chain 23 is mounted over the sprockets 21 and 22. Upon rotation of the crank shaft 4, the main shaft 46 is rotated and the shafts 18 and 19 are rotated through the sprockets 22, 21 and the chain 23. Further, the crank case 3 is subdivided into right case 3R and left case 3L, and the oil pan 5 is provided by the lower portions of the right and left cases. As shown, the oil pump 7 is secured to the right case 3R by means of bolt 24, so that both oil pump 7 and water pump 16 are secured to the right case 3R. Reference numeral 8'** designates a mesh.

Figure 8:
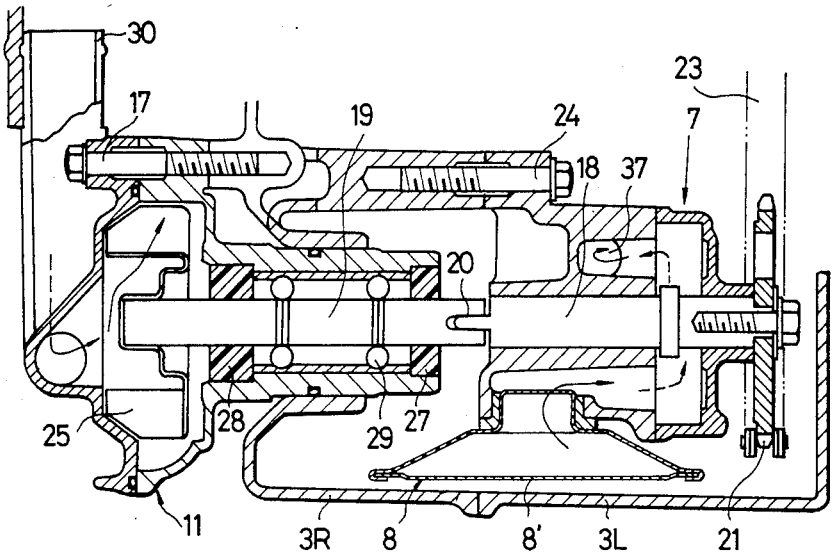
FIG. 8 is a cross-sectional view showing the water pump and the oil pump, and showing path of water and oil.

The water pump 16 provides a plurality of vanes provided integrally with one end of the shaft 18, a sleeve 26 provided concentric with the shaft 19, an oil seal 27 adapted to block oil leakage into the water pump, a water seal 28 adapted to block water leakage into the air circuit, and ball bearings 29 disposed between the shaft 19 and the sleeve 26. This construction is also shown in FIG. 8.

FIG. 6 shows side views of an essential portion of the subject invention, wherein a cover **16*a* (FIG. 7) of the water pump is removed. In this drawing, the oil pump is not shown since it is disposed below the water pump in the drawing sheet. The water pump is connected to one end of a water pipe 30 (see also FIG. 1) whose other end is connected to a radiator 31 disposed in front of the down tubes 13. Further, a pair of water pipes 32*a* and 32*b* are connected between the water pump 16 and the cylinders 2*a* to cool the latter. The water passing through the cylinders is returned to the radiator 31 through water conduit 33 (FIG. 4). As is apparent from FIG. 6, the oil filter 9' is disposed at the rear side of the crank case 3. The oil filter 9' is positioned below an output shaft 34. The oil filter 9' is provided with a polygonal head 9*a* so that it can be removed from the crank case by fitting a tool with to the polygonal head 9*a***, and rotating the tool.

Figure 9:
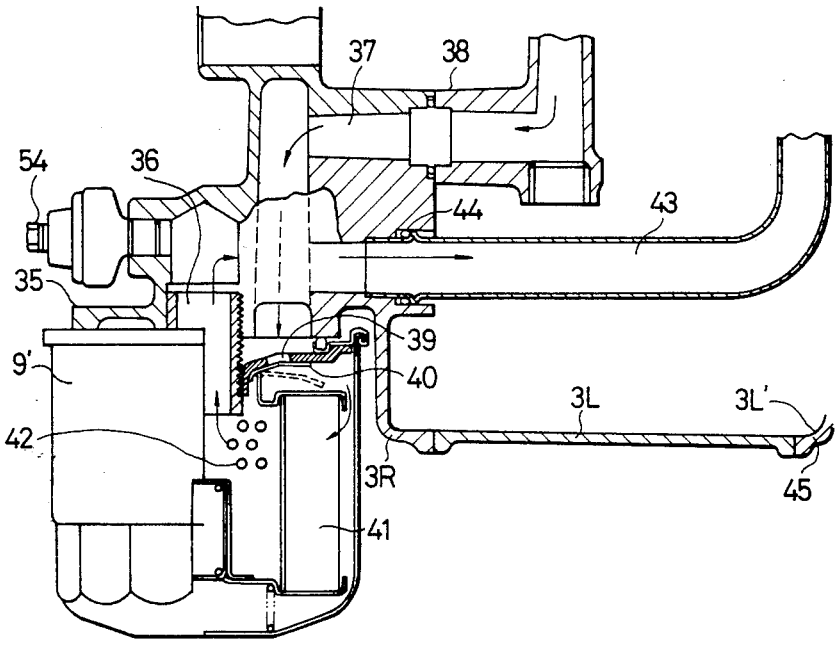
FIG. 9 is a partial cross-sectional view showing an oil path.

FIG. 9 shows an essential portion of the oil filter 9' according to the embodiment. The oil filter casing is secured to the crank case 3 by means of thread 35, whose interior is formed with a bore 36 to allow oil passage therethrough. The oil in the oil pan 5 is sucked into the oil pump 7 and is introduced into the oil filter 9' through an oil tube 37 (see also FIG. 5). Since the oil pump 7 is positioned at the left case 3L, the oil tube 37 is bent as shown. Further an O-ring 38 is provided to seal between left and right oil tubes. The oil tube is connected to an oil filter inlet 39 at which a one way valve 40 such as a lead valve is provided to prevent backflow of the oil. Within the oil filter casing 9, a filter element 41 is disposed to perform the oil filtering function. The oil passing through the filter element 41 passes through a plurality of perforations 42 to flow into the bore 36. The bore 36 is connected to an oil passage 43 having one end secured to the casing through an O-ring 44, and the other end connected to various lubricating portions. In FIG. 9, the left case 3L is coupled to a left case cover 45 and an oil pressure switch 54 is provided at the right case 3R.

Figure 10:
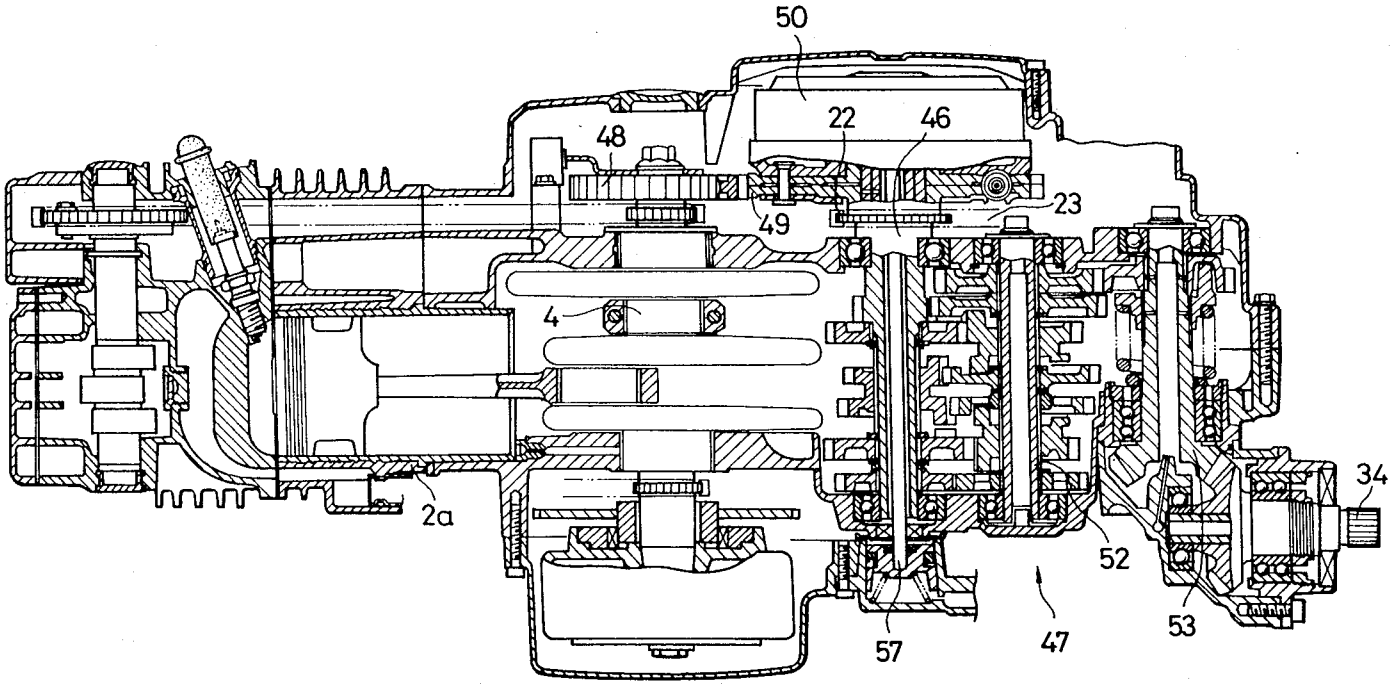
FIG. 10 is a cross-sectional view particularly showing the transmission means and crank shaft according to the invention.

For a better understanding of the present invention, FIG. 10 shows the power transmission means of the motorcycle. In FIG. 10, the rotation of the crank shaft 4 is transmitted to the transmission means 47 through gears 48,49 and a clutch 50, and the rotation is transmitted to the output shaft 34. The oil pump assembly of the subject invention is disposed below a plurality of transmission shafts 51,52,53, and therefore, is not shown in this figure.

With the structure thus organized, according to the present invention, since the oil filter is disposed at the rear side of the crank case, the oil filter casing is prevented from being splashed by mud from the front wheel, so that frequent cleaning thereof can be eliminated, and the outer appearance of the resultant motorcycle is enhanced.

Further, since the oil filter casing is positioned within a dead space defined by the crank case, exhaust pipes and the pivot shaft and down tubes if any, an effective engine layout is achievable.

Furthermore, since the oil filter casing is positioned remote from the high temperature portion such as the engine cylinders and exhaust pipes, the durability of the oil filter is prolonged.

Moreover, since the oil filter casing is positioned at the rear side of the crank case, the oil passage length can be minimized because, normally, the oil pump 7 is positioned at the rear side of the axial center of the crank shaft, to thus reduce production cost.

While the invention has been described with reference to specific embodiments thereof, it will be apparent to those skilled in the art that various changes and modifications can be made therein without departing from the scope and spirit of the invention.

What is claimed is:

1. An internal combustion engine for a motorcycle, comprising; at least one cylinder, a power transmission means, a crankcase accommodating therein said transmission means, and an oil filter disposed at the rear portion of said crankcase, said oil filter being detachably provided relative to said crankcase, and having an axis lying generally parallel to the movement direction of the motorcycle.

2. An internal combustion engine according to claim 1, further comprising an oil pump disposed within said crank case, and an oil strainer connected to an inlet of said oil pump, said oil filter being connected to an outlet of said oil pump.

3. An internal combustion engine according to claim 2, further comprising a water pump detachable from and positioned outside of said crank case, a rotary shaft of said water pump being in alignment with a rotary shaft of said oil pump.

4. An internal combustion engine according to claim 2, wherein said oil filter is positioned substantially at a lateral center of said engine and between two exhaust pipes.

5. An internal combustion engine according to claim 2, wherein said oil filter is positioned offset from a lateral center of said motorcycle and between a pair of down tubes.

6. An internal combustion engine according to claim 3, wherein said crank case is subdivided into right and left cases, said water pump being secured to said right case from outside by means of a bolt, and said oil pump being secured to said right case from inside by means of a bolt.

7. An internal combustion engine according to claim 3, wherein said rotary shaft of said oil pump has one end provided with a sprocket, and wherein said transmission means includes a main shaft provided with a sprocket, said sprockets being connected together through a chain.

8. An internal combustion engine according to claim 7, wherein said rotary shaft of said oil pump has its other end provided with one of a projection and a recess projection, and said rotary shaft of said water pump has one end provided with the other of said projection and said recess, said projection being fitted with said recess upon attachment of said water pump to said right case.

9. An internal combustion engine according to claim 6, further comprising an oil pan defined at lower portions of said right and left cases, said oil pan being positioned below said transmission means.

10. An internal combustion engine according to claim 2, further comprising a crank shaft disposed within said crank case, said oil pump being positioned at a rear side of a central axis of said crank shaft.

11. An internal combustion engine for a motorcycle, comprising; at least one cylinder, power transmission means, a crankcase accommodating therein said transmission means, and an oil filter disposed at the rear portion of said crankcase, an oil pump disposed within said crankcase,and an oil strainer connected to an inlet of said oil pump, said oil filter being connected to an outlet of said oil pump, a water pump detachable from and positioned outside of said crankcase, a rotary shaft of said water pump being substantially coaxial with a rotary shaft of said oil pump, said crankcase being subdivided into right and left cases, said water pump being secured to said right case from the outside, and said oil pump being secured to said right case from the inside, lower portions of said right and left cases together defining an oil pan, said oil strainer being disposed in said oil pan, and said oil pan being positioned below said transmission means.

12. An internal combustion engine according to claim 11, wherein said rotary shaft of said oil pump has one end provided with a sprocket, and wherein said transmission means includes a main shaft provided with a sprocket, said sprockets being connected together through a chain.

13. An internal combustion engine according to claim 12, wherein said rotary shaft of said oil pump has its other end provided with one of a projection and a recess, and said rotary shaft of said water pump has one end provided with the other of said projection and said recess, said projection being fitted with said recess upon attachment of said water pump to said right case.

* * * * *